US005918784A

United States Patent [19]

Serpa

[11] Patent Number: 5,918,784

[45] Date of Patent: Jul. 6, 1999

[54] QUICK-RELEASE HANDGUN HOLSTER

[76] Inventor: Michael Lawrence Serpa, P.O. Box 2693, Newport Beach, Calif. 92659

[21] Appl. No.: 08/978,306

[22] Filed: Nov. 25, 1997

[51] Int. Cl.[6] ..... F41C 33/02

[52] U.S. Cl. ..... 224/244; 224/911

[58] Field of Search ..... 224/244, 245, 224/243, 911, 193; 248/316.2, 316.5, 316.7; 24/557, 555, 664

[56] References Cited

U.S. PATENT DOCUMENTS

| | | |
|---|---|---|
| 1,635,984 | 7/1927 | Corriston . |
| 1,641,439 | 9/1927 | Jovino . |
| 2,551,913 | 5/1951 | Toby . |
| 3,669,325 | 6/1972 | Furman . |
| 5,279,021 | 1/1994 | Edgin ..... 24/664 |

*Primary Examiner*—Allan N. Shoap
*Assistant Examiner*—Maerena W. Brevard

[57] ABSTRACT

A quick-release handgun holster that has a latch device comprising a lever (20) with an engagement end (22) and a finger button end (24), the engagement end having a locking face (25) for retaining a handgun in the holster by engaging the trigger guard. An outer wall (36) prevents the engagement end from touching the trigger of the handgun by limiting how far the handgun can be inserted into the holster. A support wall (32) and a guide wall (34) facilitate alignment of the trigger guard with the locking face by limiting lateral movement of the handgun with respect to the lever. Quick release operation is provided by a spring-loaded tongue (23) that moves the handgun outward past the lock point when the finger button end is urged.

5 Claims, 6 Drawing Sheets

QUICK-RELEASE HANDGUN HOLSTER

This application is related to my prior application Ser. No. 08/714,653 which was filed on Sep. 16, 1996 and abandoned on Sep. 27, 1997.

FIELD OF THE INVENTION

This invention relates to handgun holsters, specifically to holsters that include latch devices for securing a handgun in the holster.

BACKGROUND OF THE INVENTION

Many users of handguns, particularly military and law enforcement personnel, carry a handgun in a holster designed to protect the handgun and hold it securely. Holsters can be worn in a number of ways, such as on a belt at the waist, under an armpit, or around an ankle.

Certain users of handguns must be able to quickly and easily remove a handgun from a holster regardless of the type of holster used. Additionally, these users need to be assured that, when not in use, the handgun will remain safely in the holster. Because some methods of retaining a handgun in a holster do not permit a user to quickly release the handgun using one hand only, a need exists for an improved handgun holster retainer latch that can be easily operated with the same hand that withdraws the firearm from the holster.

DISCUSSION OF PRIOR ART

Some holsters rely solely on friction to secure the handgun in place. This combination might not be suitable for situations where the gun/holster is subject to a great deal of movement because such movement could cause the handgun to loose frictional engagement with the holster.

Other devices include a variety of strap or flap arrangements that prevent the removal of the firearm from the holster while the strap or flap is in place. With designs that rely on this method to retain a handgun, a user must first unfasten the strap/flap before the firearm can be withdrawn. Some users might not prefer this design because of the time required to release the handgun.

Two other designs provide alternative methods for retaining a handgun in a holster: Furman, U.S. Pat. No. 3,669,325 issued Jun. 13, 1972; and Toby, U.S. Pat. No. 2,551,913 issued May 8, 1951. The Furman design provides a rigid holster having a spring biased, pivoting, arcuate lever arm that engages the trigger guard of a handgun in order to retain a handgun in the holster. This design, however, creates some disadvantages.

First among these disadvantages is the totally rigid holster, which might not be preferred by all users for comfort or other reasons. Second, this designs includes a number of component parts, thus complicating its manufacture and assembly as well as possibly increasing the risk of failure while in use.

Third, this design would not be compatible with handguns, particularly modern semiautomatic handguns, whose trigger guards do not have arcuate profiles. To use the Furman design with such a handgun would require an extremely strong spring on the arcuate lever to force the handgun against the upper portion of the rigid holster, possibly making manufacture or use impractical.

A final disadvantage of the Furman design is that a user might, when attempting to quickly remove a handgun from the holster, inadvertently grasp the handle of the handgun in such a way that one or more fingers of the user's hand interfere with the downward movement of the arcuate lever making removal of the firearm difficult.

The Toby design provides a latch mechanism comprising a pair of elongated parallel overlying plates pivotally connected at one end. Opposite the connected end is a latch mechanism that hooks a portion of the trigger guard of a handgun, thus retaining the handgun in the holster.

As with the Furman design, the manufacture and assembly of the Toby design is complicated by the use of separate moving parts and a number of components. Additionally, these factors possibly increase the risk of failure while in use.

Furthermore, the Toby design might not be compatible with some handguns because the design places both the latch tongue and the finger press means on the same side of the pivot point, with the distance between the pivot point and the finger press means being shorter than the distance between the pivot point and the latch tongue. When used with handguns, particularly semiautomatic handguns, having trigger guards extending relatively far forward towards the muzzle of the handgun, the finger press means of the Toby design might be located too far forward for a user to comfortably and easily operate while grasping the handle of the firearm.

Another design providing a handgun holster with a retainer latch is Corriston, U.S. Pat. No. 1,635,984 issued Jul. 19, 1927. Corriston provides a U-shaped plate attached to a holster and including a hook that engages the trigger guard of a handgun thereby retaining it in the holster. This design would be difficult for some users to operate with one hand because the finger piece, which disengages the hook from the trigger guard, is located forward of the trigger guard. A user must move the finger piece while, at the same time, pull on the handle of the handgun and move the handgun outward past the point where the hook engages the trigger guard. The location of the finger piece in the Corriston design makes this difficult.

Another significant disadvantage of Corriston is that the location and orientation of the lever, and the fact that the lever pivots on a stud, precludes this design from being manufactured as an integral unit by injection molding production techniques. This puts Corriston at an economic disadvantage over other designs capable of being produced with this process. The Corriston design must be manufactured and assembled from multiple component parts.

Furthermore, because Corriston does not completely conceal the trigger of the handgun while it is in the holster, this arrangement might be considered unsafe by some users.

A final design providing a latch device for retaining a handgun in a holster is Jovino, U.S. Pat. No. 1,641,439 issued Sep. 6, 1927. Jovino provides a yoke-shaped latch device contained inside a holster. The latch device includes a lever with a knob end and a catch arm end for retaining the handgun. A primary disadvantage of Jovino is that the latch device is comprised of multiple component parts and then installed in the holster, resulting in a relatively complicated assembly process.

The difficult nature of this assembly process is further complicated because the yoke-shaped latch of Jovino only controls the lateral, forward, and rearward movement of the handgun while it is in the holster. Upward and downward movement of the handgun is controlled by the holster itself, requiring that each individual holster/latch combination be constructed with precision to assure that the catch nose obtains the correct alignment with the trigger guard when a particular handgun is inserted into the holster.

However, the most significant disadvantage of the Jovino design is that a user must operate the knob to disengage the catch nose while, at the same time, pull outward on the handle of the handgun to move the handgun past the point where the catch nose engages the trigger guard. As with the Toby and Corriston designs, a user of the Jovino latch might find it difficult to urge the lever while, at the same time and with the same hand, pulling the handgun outward.

OBJECTS AND ADVANTAGES

Accordingly it is an object and advantage of the present invention to provide a holster with a quick-release latch device that is simple and safe to operate with one hand, reliable and durable in design, and capable of retaining a handgun securely in the holster while permitting a quick release when the user requires.

A further object of the present invention is to provide a handgun holster with an improved latch device capable of being economically manufactured using injection molding production techniques.

A still further object of the present invention is to provide a handgun holster with a latch device capable of being easily mass-produced to precisely fit a variety of handguns.

Further objects and advantages will become apparent from a consideration of the ensuing description and drawings.

DRAWING FIGURES

DESCRIPTION-FIGS. 1 to 5

Figure 1:
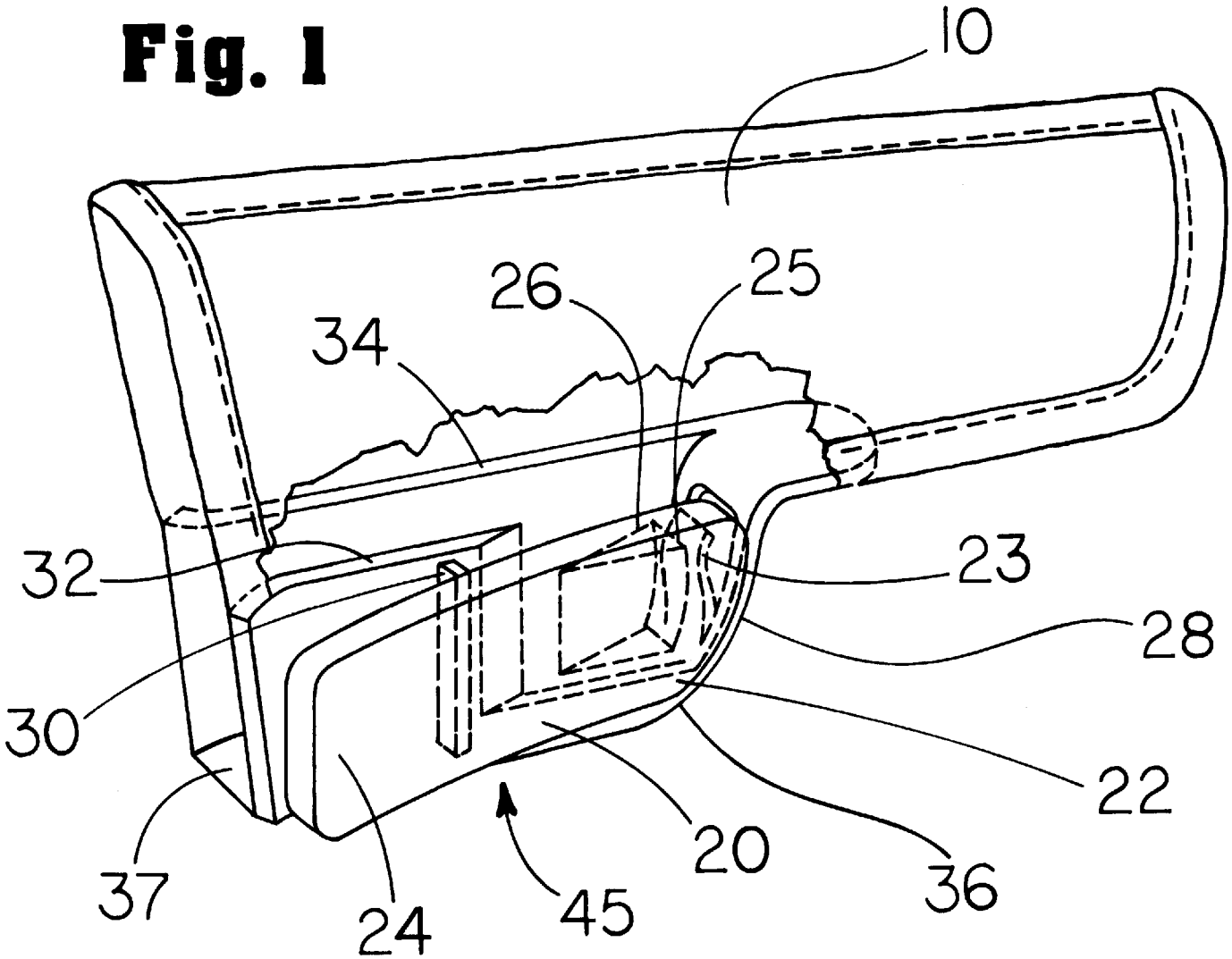
FIG. 1 is a perspective view of the present invention with the holster shown partially cut away.

The overall arrangement of the present invention can best be seen in FIG. 1. A holster 10 is shaped to enclose a handgun and may be constructed of any suitable material such as leather or woven nylon cloth. Additionally, the holster 10 might include, though not illustrated here, additional elements such as a loop for attaching the holster 10 to a belt, or straps for securing the holster 10 around a user's shoulder or ankle.

A unitary quick-release latch device 45 is attached to the holster 10 and, when so attached, takes the place of a portion of the holster 10. A holstered weapon's movement in a direction away from the latch device 45 is controlled and restricted by the holster 10, while movement of the weapon in all other directions is restricted by the latch device 45 itself. The latch device 45 is preferably molded from a strong resilient plastic material such as nylon and may be secured to the holster 10 by rivets, high-strength adhesive, or any other suitable method.

Referring still to FIG. 1, the latch device includes a lever 20 having an engagement end 22 and a finger button end 24. The engagement end 22 comprises a locking face 25 and a ramp surface 26. The lever 20 may also include a stop tab 28 extending from the engagement end 22.

The lever 20 is attached to a support wall 32 by a fulcrum or pivot 30. The pivot 30 may extend all or part of the way across the width of the lever 20. The pivot 30 should be thinner than the support wall 32 and the lever 20 to ensure that the pivot 30 flexes properly when the finger button end 24 is urged, as will be more fully discussed below.

Opposite the support wall 32 is a guide wall 34. The support wall 32 and the guide wall 34 are spaced apart from each other a distance slightly in excess of the width of the trigger guard of the particular handgun used. In FIG. 1, the support wall 32 and the guide wall 34 are substantially parallel to each other, but it is noted here that this might not always be the case. The support wall 32 and the guide wall 34, by conforming to the dimensions of the trigger guard, control the lateral movement of the particular handgun used while it is in the holster 10 yet are not spaced so close so as to prevent a user from easily holstering or drawing their firearm.

The support wall 32 and the guide wall 34 are joined to an outer wall 36. Together, the support wall 32, the guide wall 34, and the outer wall 36 form an open end 37 proximal to the finger button end 24 of the lever 20.

The outer wall 36 includes a spring-loaded button or tongue 23 that is preferably located opposite the locking face 25 of the lever 20. The spring-loaded tongue 23 extends from the outer wall 36 towards the locking face 25, covering substantially the entire distance between the outer wall 36 and the locking face 25. However the spring-loaded tongue 23 does not touch the locking face 25.

The spring-loaded tongue 23 may be configured in a number of ways, and it can be attached to the outer wall 36 by any suitable method. Additionally, any suitable spring mechanism can be used. In the preferred embodiment the spring-loaded tongue 23 is molded as an integral part of the outer wall 36 as shown in the drawings. If produced in this way, the thickness of the spring-loaded tongue 23 will depend on the rigidity of the particular material used. In general, the spring-loaded tongue 23 would be thinner than the outer wall 36 in order to give the spring-loaded tongue 23 the desired flex characteristics. As will be explained in detail below, the spring-loaded tongue 23 is the essential element providing a true one-handed operation of the present invention.

Figure 3:
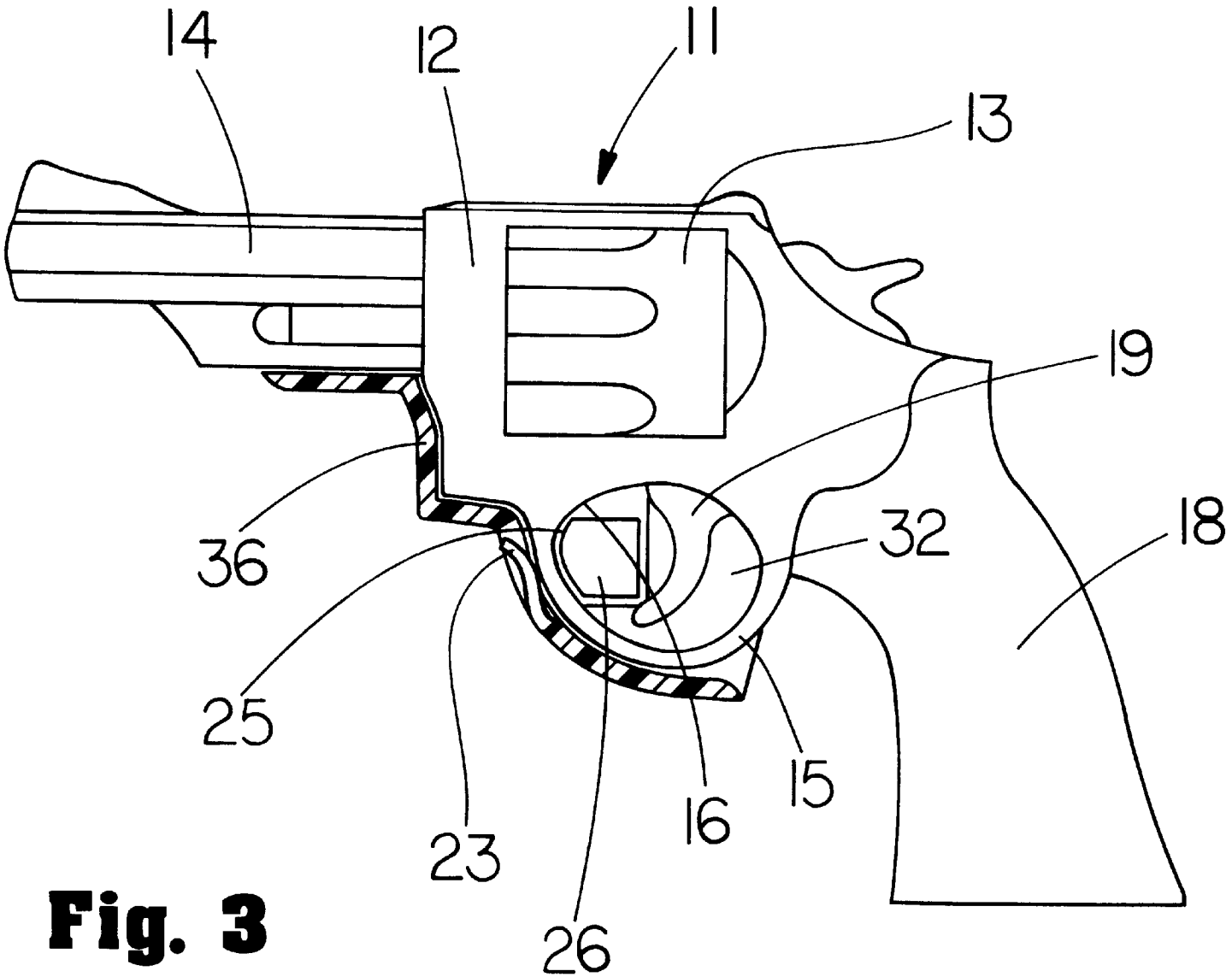
FIG. 3 is a sectional view showing the latch device adapted for use with a revolver-type handgun.

In the preferred embodiment, the latch device 45 position of the present invention is molded to fit the shape of the particular handgun used. FIG. 3 shows a revolver-type handgun indicated in general by reference number 11. The revolver-type handgun includes a frame 12, a cylinder 13, a barrel 14, a grip 18, a trigger 19, and a trigger guard 15. The trigger guard has an inner surface 16 and an outer surface 17.

As FIG. 3 further illustrates, the latch device 45 can be adapted for use with a revolver-type handgun 11. The locking face 25 is shaped generally to match the contour of a portion of the inner surface 16 of the trigger guard 15, and the outer wall 36 is shaped generally to match the contour of the outer surface 17 of the trigger guard 15. The spring-loaded tongue 23 is compressed and holds the trigger guard 15 against the locking face 25.

Figure 4:
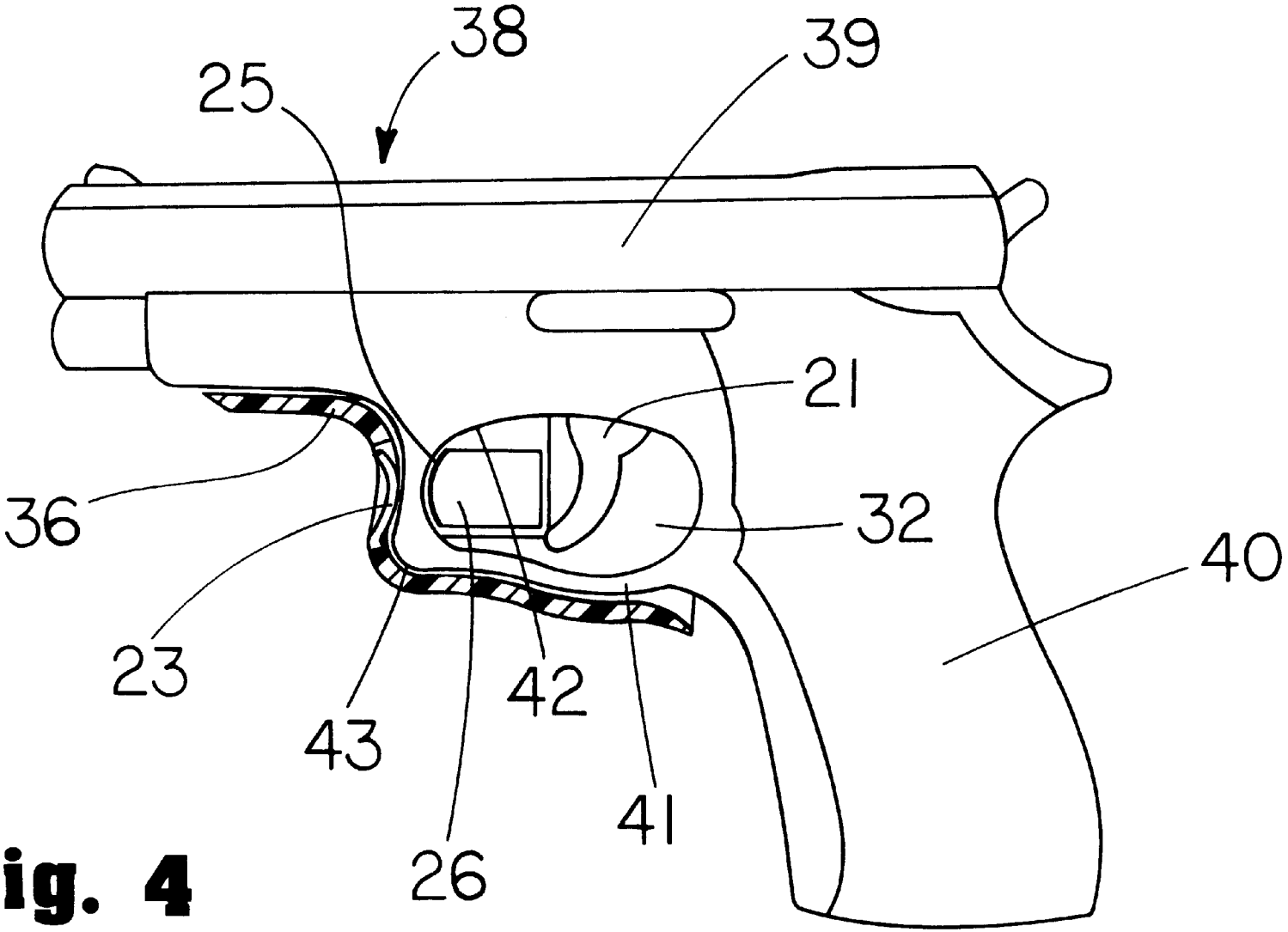
FIG. 4 is a sectional view showing the latch device adapted for use with a semiautomatic-type handgun.

Similar to FIG. 3, FIG. 4 shows the latch device 45 adapted for use with a semiautomatic-type handgun, indicated in general by reference number 38. The semiautomatic-type handgun 38 includes a slide 39, a grip 40, a trigger 21, and a trigger guard 41 having an inner surface 42 and an outer surface 43. The locking face 25 is shaped generally to match the contour of a portion of the inner surface 42 of the trigger guard 41, and the outer wall 36 is shaped generally to match the contours of the outer surface 43 of the trigger guard 41. The trigger guard 41 is held against the locking face 25 by the compressed spring-loaded tongue 23.

Regardless of the particular handgun used, the ramp surface 26 should be shaped so that there is no possibility that it can at any time contact the trigger of the handgun. When the handgun is pushed as far forward as possible into the holster, and the trigger guard has come to rest against the outer wall 36 and the spring-loaded tongue 23, there should be a space between the ramp surface and the trigger of the handgun.

Figure 2:
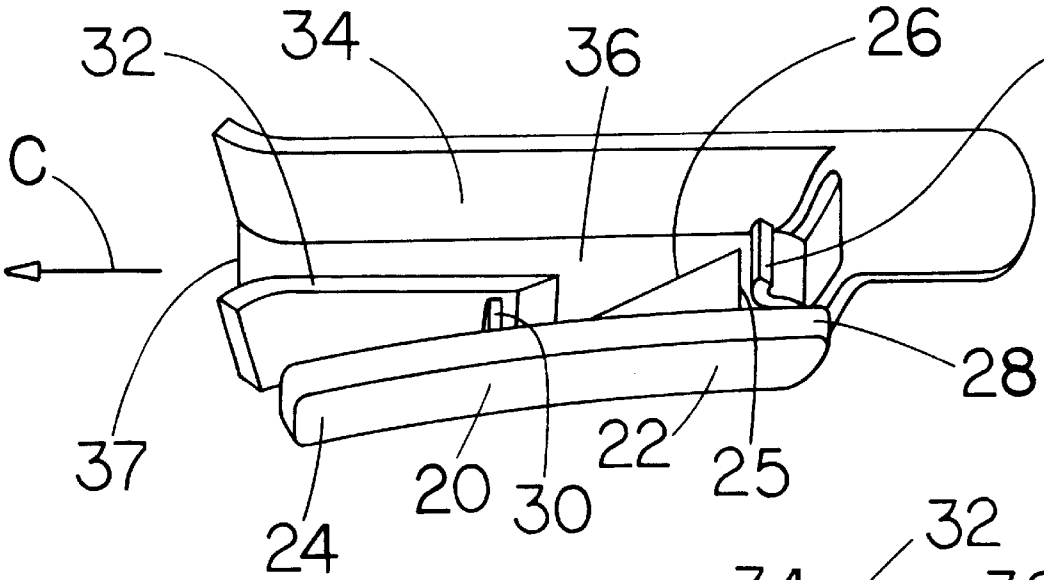
FIG. 2 is a top perspective view of the latch device portion of the present invention.

In addition, when the lever 20 is in the position shown in FIG. 2 and is locking a handgun in place, the clearance between the locking face 25 and the outer wall 36 should be such that there is room for the slight arc movement of the locking face 25 when the finger button end 24 is urged.

FIGS. 3 and 4 are intended as examples only and are not to be construed as limiting the scope of the present invention. In the preferred embodiment, both the latch device and the holster are shaped to fit the particular handgun used.

Also, the outer wall 36, the guide wall 34, and the support wall 32 may be flared slightly at the open end 37 to guide the trigger guard of the particular handgun used as the handgun is inserted into the holster 10.

Figure 5:
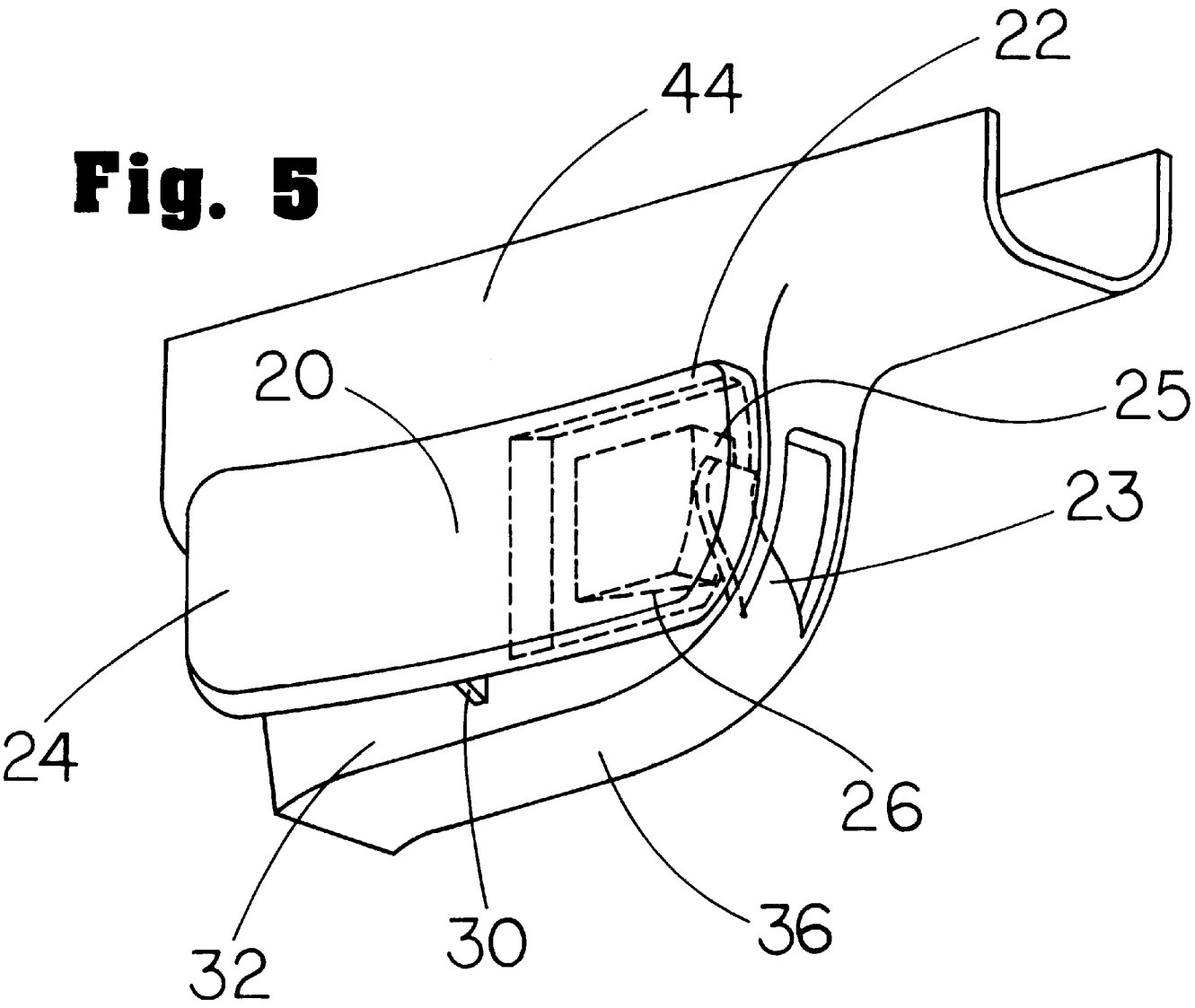
FIG. 5 is a perspective view of the latch device.

The latch device 45 may further include an upper extension 44 as shown in FIG. 5. In the preferred embodiment the upper extension 44 is molded as part of the support wall 32, the guide wall 34, and outer wall 36 and conforms generally to the contours of the particular handgun used. The upper extension 44, if included, performs three functions. First, it adds strength and rigidity to the entire structure of the latch device 45. Second, it serves as a point of attachment for securing the latch device 45 to the holster 10. And third, it serves to help guide a handgun into the holster 10.

OPERATION-FIGS. 2 THROUGH 4 AND 6 THROUGH 8

This discussion, though describing the operation of the present invention as used with a revolver-type handgun, applies also to the operation of the present invention when used with a semiautomatic-type handgun.

Figure 6:
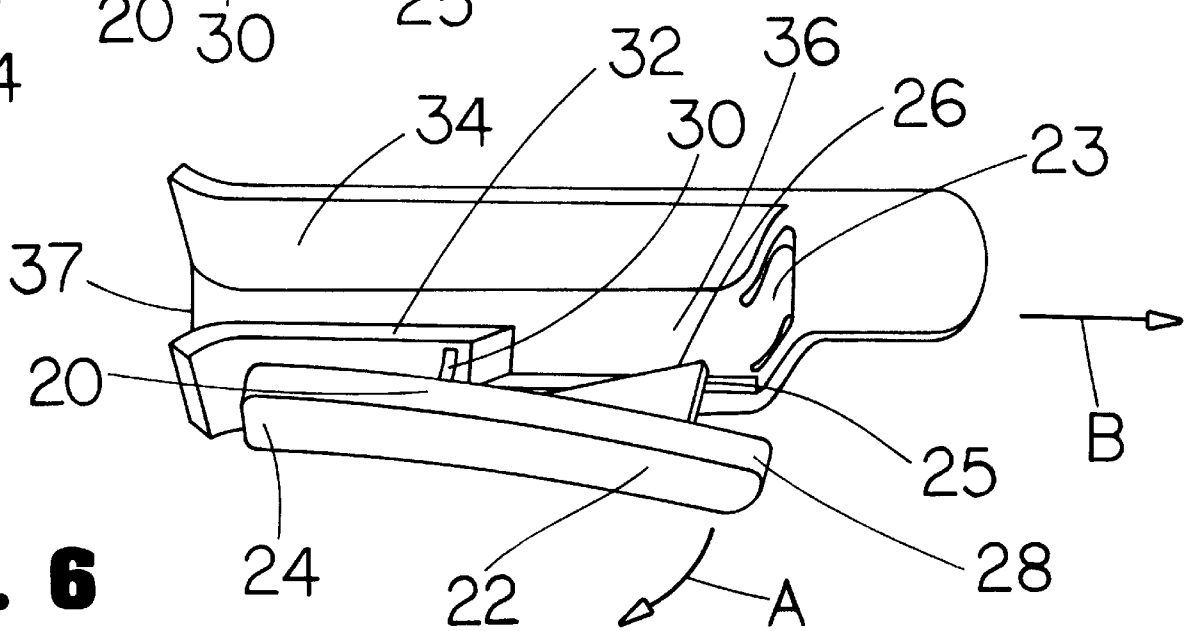
FIG. 6 is a top perspective view of the latch device showing the lever moved to a position that permits the insertion or removal of a handgun and showing the flexible tongue moved to a forward position.
Figure 7:
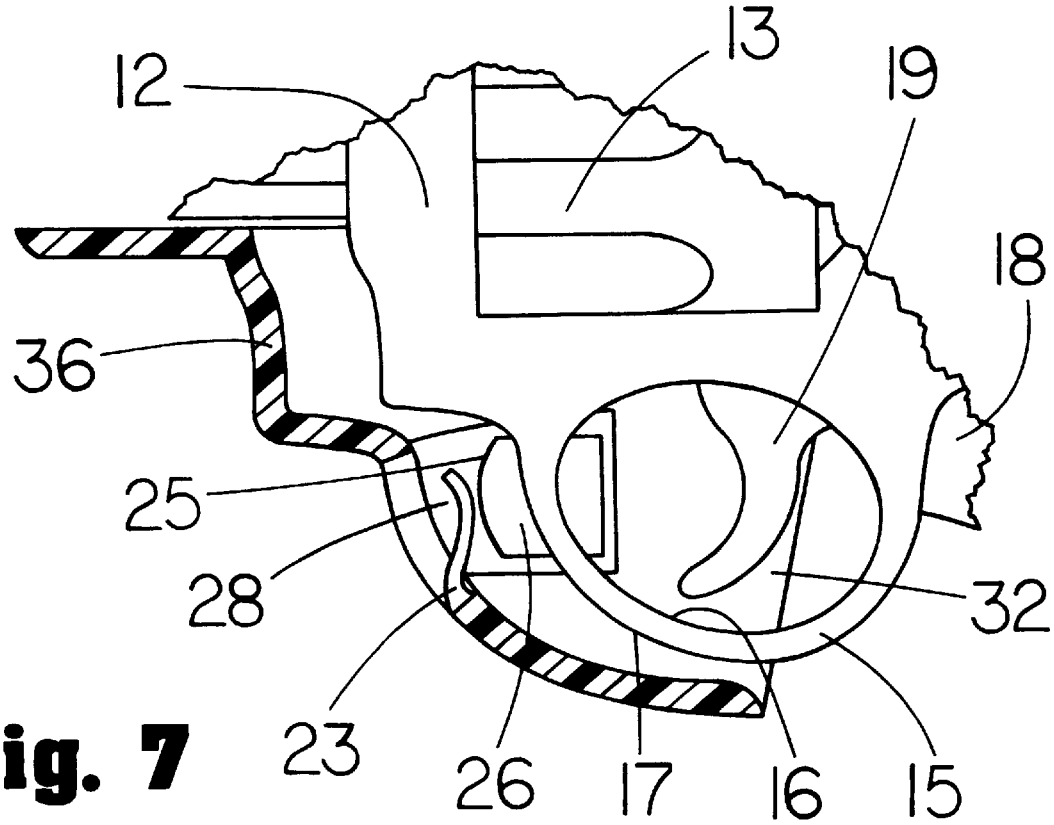
FIG. 7 is an enlarged sectional view, similar to FIG. 3, showing the trigger guard portion of a revolver-type handgun in an unlatched position within the latch device.

The latch device 45 portion of the present invention will secure a revolver-type handgun within the holster by action of the locking face 25 engaging the trigger guard of the handgun. Referring to FIGS. 3, 6, and 7, as a user begins to holster the revolver-type handgun 11 the trigger guard 15 will enter the open end 37. The trigger guard 15 will be guided by the guide wall 34, the support wall 32, and the outer wall 36.

As the revolver-type handgun 11 is inserted further, the trigger guard 15 will contact the ramp surface 26 and begin to displace the engagement end 22 of the lever 20 in the direction of arrow "A" in FIG. 6. The trigger guard 15 is prevented from moving in a direction opposite the ramp surface 26 by the position of the guide wall 34. When the trigger guard 15 begins to clear the ramp surface 26, the outer surface 17 will contact the spring-loaded tongue 23 and begin to displace the spring-loaded tongue 23 in the direction of arrow "B" in FIG. 6.

The lever 20 will continue to move until the trigger guard 15 has cleared the ramp surface 26, whereupon the lever 20 will snap back into the original position shown in FIG. 2. At this point the spring-loaded tongue 23 will be compressed and substantially flush with the outer wall 36 as shown in FIG. 6. When the user ceases to apply an insertion force, the tension of the spring-loaded tongue 23 will hold the trigger guard 15 against the locking face 25.

The revolver-type handgun 11 is secured in place by operation of the locking face 25 contacting the inner surface 16 of the trigger guard 15. Any removal force applied will have no effect unless the finger button end 24 is urged. FIG. 3 illustrates the revolver-type handgun 11 in this locked position.

The preferred configuration of the locking face 25 is for it to extend from the lever 20 for a distance that is less than the width of the trigger guard 15. This is because a removal force, in the direction of arrow "C" in FIG. 2, will create a pressure on the engagement end 22 in the direction of the guide wall 34 by action of the inner surface 16 of the trigger guard 15 pushing on the locking face 25. This action will have the effect of increasing the retaining force. The stop tab 28, if included, prevents the engagement end 22 from moving too far towards the guide wall 34.

To release the revolver-type handgun 11, the finger button end 24 of the lever 20 is urged inward towards the support wall 32. At some point the support wall 32 will stop the inward movement of the finger button end 24, thus eliminating the possibility that the finger button end 24 can prevent the removal of the revolver-type handgun 11 by contacting the trigger 19 or constricting the trigger guard 15. When the locking face 25 clears the inner surface 16 of the trigger guard 15, the pressure exerted by the spring-loaded tongue 23 on the outer surface 17 of the trigger guard 15 will push the revolver-type handgun 11 outward past the point at which the locking face 25 contacts the inner surface 16.

At this time the user can release the finger button end 24, whereupon the lever 20 will return to its original position. The revolver-type handgun 11 will no longer be locked in place and the user can now grasp the grip 18 and draw the weapon. Because the spring-loaded tongue 23 moves the trigger guard 15 outward past the locking point as shown in FIG. 7, a user does not have to urge the finger button end 24 at the same time he/she pulls outward on the grip 18. The action of the spring-loaded tongue 23 thus facilitates a simple one-handed operation.

Figure 8:
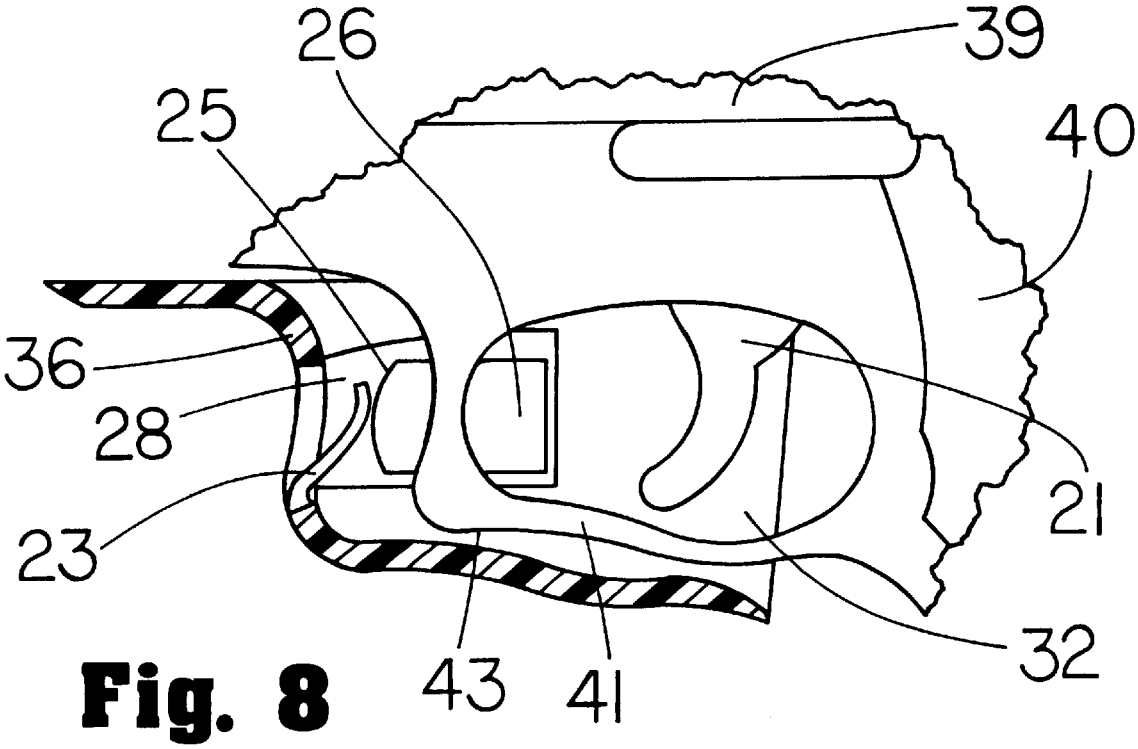
FIG. 8 is an enlarged sectional view, similar to FIG. 4, showing the trigger guard portion of a semiautomatic-type handgun in an unlatched position within the latch device.

The above description also applies to the operation of the present invention when adapted for use with a semiautomatic-type handgun. As shown in FIG. 4, the spring-loaded tongue 23 is in the fully compressed position when the semiautomatic-type handgun 38 is secured in place. The inner surface 42 of the trigger guard 41 is held against the locking face 25, and the outer surface 43 rests against the outer wall 36. In FIG. 8, the spring-loaded tongue 23 has flexed backward moving the trigger guard 41 past the locking face 25.

SUMMARY, RAMIFICATIONS, AND SCOPE

Accordingly, this invention provides a safe and reliable quick-release handgun holster. It is safe because at no time does any portion of the latch device touch the trigger of the firearm. It is reliable because the latch device provides a strong retaining force and can be injection molded from a durable material such as nylon. Furthermore, the present invention has other advantages in that:

The above description should not be construed as limiting the scope of the invention but rather as an illustration of the preferred embodiment. Many variations are possible, such as assembling the latch device from separately manufactured component parts or constructing the spring-loaded tongue as a button that relies on a metal coil spring. So long as they operate as described, each element of the present invention may assume a variety of configurations.

I claim:

1. A holster, for a handgun having a trigger and a trigger guard, comprising:

a pocket shaped to receive the handgun;

a latch device, the latch device including a moveable lever with an engagement end and a finger button end, the moveable lever arranged to pivot at a point located between the engagement end and the finger button end;

a locking face on the engagement end, the locking face shaped and positioned to secure the handgun in the holster by engaging the trigger guard such that removal of the handgun from the holster requires urging of the finger button end;

a spring loaded button or tongue configured to bias the handgun, when the handgun is in the holster, into a position where the locking face cannot engage the trigger guard.

2. The combination described in claim 1, wherein:

the latch device includes an outer wall that limits how far the handgun can be inserted into the holster.

3. The combination described in claim 1, wherein:

the latch device includes an outer wall that limits how far the handgun can be inserted into the holster; and the latch device includes a support wall, located proximal to the moveable lever, that prevents the finger button end from contacting the trigger of the handgun when the finger button end is urged.

4. The combination described in claim 1, wherein:

the latch device includes an outer wall that limits how far the handgun can be inserted into the holster; and the latch device includes a support wall, located proximal to the moveable lever, that prevents the finger button end from contacting the trigger of the handgun when the finger button end is urged; and the latch device includes a side wall that serves to help align the trigger guard of the handgun with the engagement end by restricting movement of the handgun in a direction away from the moveable lever.

5. The combination described in claim 1, wherein:

the latch device includes an outer wall that limits how far the handgun can be inserted into the holster; and the latch device includes a support wall, located proximal to the moveable lever, that prevents the finger button end from contacting the trigger of the handgun when the finger button end is urged; and the latch device includes a side wall that serves to help align the trigger guard of the handgun with the engagement end by restricting movement of the handgun in a direction away from the moveable lever; and the engagement end includes a ramp surface proximal to the locking face configured such that, as the handgun is inserted into the holster, the trigger guard will contact the ramp surface and thereby displace the engagement end in a direction away from the trigger guard until a point at which the ramp surface is no longer in contact with the trigger guard, whereupon the engagement end will move in a direction toward the trigger guard and secure the handgun in the holster.

* * * * *